US007911292B2

(12) United States Patent
Byun et al.

(10) Patent No.: US 7,911,292 B2
(45) Date of Patent: Mar. 22, 2011

(54) MODE TRANSITION BETWEEN A PLANAR LINE AND A WAVEGUIDE WITH A LOW LOSS RF SUBSTRATE AND A HIGH LOSS LOW FREQUENCY SUBSTRATE

(75) Inventors: Woo-Jin Byun, Daejon (KR); Kwang-Seon Kim, Daejon (KR); Bong-Su Kim, Daejon (KR); Ki-Chan Eun, Daejon (KR); Myung-Sun Song, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 213 days.

(21) Appl. No.: 12/096,784

(22) PCT Filed: Nov. 24, 2006

(86) PCT No.: PCT/KR2006/004984

§ 371 (c)(1),
(2), (4) Date: Jun. 9, 2008

(87) PCT Pub. No.: WO2007/066917

PCT Pub. Date: Jun. 14, 2007

(65) Prior Publication Data

US 2008/0297283 A1 Dec. 4, 2008

(30) Foreign Application Priority Data

Dec. 8, 2005 (KR) ..... 10-2005-0119620
Jul. 31, 2006 (KR) ..... 10-2006-0072417

(51) Int. Cl.
*H01P 5/107* (2006.01)

(52) U.S. Cl. ..... 333/26

(58) Field of Classification Search ..... 333/26, 333/248
See application file for complete search history.

(56) References Cited

U.S. PATENT DOCUMENTS 5,982,250 A 11/1999 Hung et al.
(Continued)

FOREIGN PATENT DOCUMENTS

JP 08-125432 * 5/1996
(Continued)

OTHER PUBLICATIONS

RongLin Li et al., "Design of Compact Stacked-Patch Antennas in LTCC Multilayer Packaging Modules for Wireless Applications", 2004 IEEE Transactions on Advanced Packaging, vol. 27, No. 4, Nov. 2004, pp. 581-589.

(Continued)

*Primary Examiner* — Benny Lee
(74) *Attorney, Agent, or Firm* — Kile Park Goekjian Reed & McManus PLLC

(57) ABSTRACT

Provided is a mode transition circuit for transferring a RF signal and a transceiver module having the same. The mode transition circuit includes: a planar transmission line mounted at a RF substrate for receiving a RF signal from a RF signal generating unit; a via formed inside the RF substrate and connected to one side of the planar transmission line for receiving the RF signal from the planar transmission line; at least one of metal patches formed inside the RF substrate and connected to the one side of the via for receiving the RF signal from the via; and a hole formed inside a low frequency substrate and connected to one side of the metal patch for receiving the RF signal from the metal patch.

14 Claims, 4 Drawing Sheets

U.S. PATENT DOCUMENTS

| | | | | |
|---|---|---|---|---|
| 6,822,528 | B2 * | 11/2004 | Dawn et al. | 333/26 |
| 6,940,361 | B1 | 9/2005 | Jokio et al. | |
| 2003/0231078 | A1 * | 12/2003 | Koriyama et al. | 333/26 |
| 2007/0120618 | A1 * | 5/2007 | Peulevey et al. | 333/26 |

FOREIGN PATENT DOCUMENTS

| | | |
|---|---|---|
| JP | 2000-261235 | 9/2000 |
| JP | 2001-060889 | 3/2001 |
| JP | 2005-027299 | 1/2005 |
| KR | 10-2004-0052473 | 6/2004 |

OTHER PUBLICATIONS

Woojin Byun, et al., "Design of Waveguide-to-Microstrip Line Transition for the integration of a Transceiver Module and an Array Antenna", 2006 IEEK Spring Thesis of Microwave and Radio wave Academic Meeting pp. 99-109, May 2006.

Woojin Byun, et al., LTCC Microstrip Patch Array Antenna with WR-22 Feeding Structure for an Integrated Transceiver Module, 2006 IEEE Antennas and Progagation Society International Symposium with USNC/URSI National Radio Science and AMEREM Meeting, pp. 1495-1499, Jul. 2006.

International Search Report for PCT/KR2006/004984 dated Feb. 20, 2007.

* cited by examiner

[Fig. 1]

[Fig. 4]
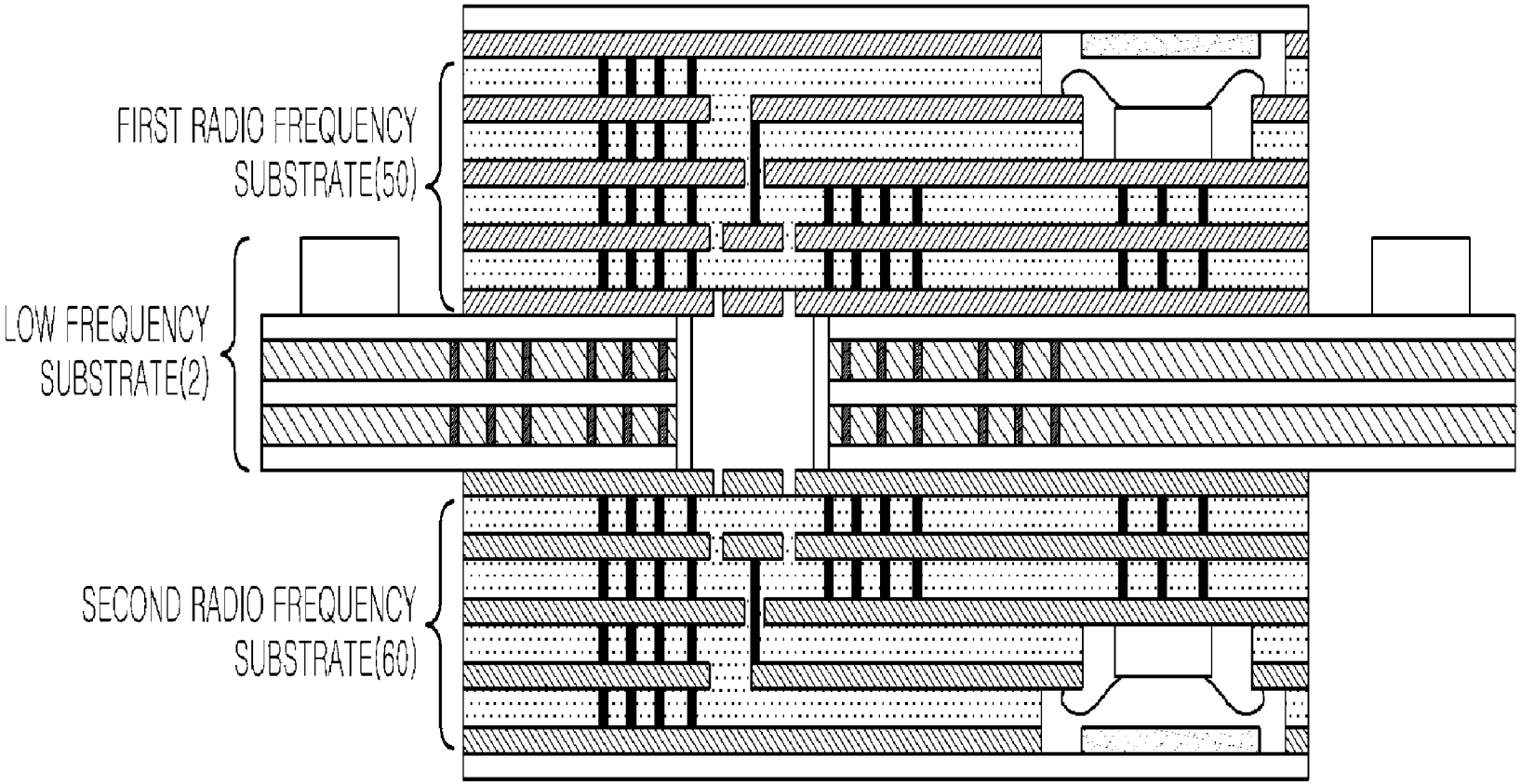

MODE TRANSITION BETWEEN A PLANAR LINE AND A WAVEGUIDE WITH A LOW LOSS RF SUBSTRATE AND A HIGH LOSS LOW FREQUENCY SUBSTRATE

TECHNICAL FIELD

The present invention relates to a mode transition circuit for transferring a radio frequency (RF) signal and a transceiver module having the same; and more particularly, to a mode transition circuit for transferring a Radio Frequency signal generated from a RF substrate to a module such as an antenna through a planar transmission line and a waveguide including vias and metal patches formed inside the RF substrate and a hole formed inside a low frequency substrate, and a transceiver module having the same.

BACKGROUND ART

A mode transition circuit for transferring a radio frequency (RF) signal and a transceiver module having the same are generally formed of a substrate having a predetermined dielectric constant that allows it to be operated in a RF domain. Particularly, the mode transition circuit is generally embodied using a micro-strip line to waveguide transition, which shows quasi TEM to TE01 mode transition. Since the micro-strip line must include a conductive element such as a back-short, the micro-strip line is not proper in a view of miniaturizing a mode transition circuit.

In order to overcome such a shortcoming of the conventional mode transition circuit, there were many research projects in progress for embodying a mode transition circuit using a metal waveguide filled with an air or a waveguide filled with a dielectric. However, a transmission line such as micro-strip line is still required to connect active elements and a mode transition circuit so the signal loss is unescapable due to the transmission line.

A conventional technology to embody a RF module using a mode transition circuit was introduced in U.S. Pat. No. 5,982,250 entitled "MILLIMETER-WAVE LTCC PACKAGE." The conventional technology of U.S. Pat. No. 5,982,250 discloses a single-layer substrate made of alumina, or a multi-layered substrate formed by a Low Temperature Co-Fired Ceramics (LTCC) process.

However, the conventional technology of U.S. Pat. No. 5,982,250 still has a shortcoming of a high manufacturing cost and a difficulty of integration if it is integrated with circuits operated in a low frequency circuit, such as a baseband processor or a power integration chip (IC).

Generally, a low frequency substrate made of inexpensive material such as FR4 is used to integrate a baseband processor or a power IC. However, FR4 has a great substrate loss, and it is not easy to form a RF module using FR4.

SUMMARY OF THE INVENTION

Technical Problem

It is, therefore, an object of the present invention to a mode transition circuit for transferring a Radio Frequency (RF) signal generated from a RF substrate to a module such as an antenna through a planar transmission line and a waveguide including vias and metal patches formed inside the RF substrate and a hole formed inside a low frequency substrate, and a transceiver module having the same.

Technical Solution

In accordance with one aspect of the present invention, there is provided a mode transition circuit for transferring a radio frequency (RF) signal including: a planar transmission line mounted at a RF substrate for receiving a RF signal from a RF signal generating means; a via formed inside the RF substrate and connected to one side of the planar transmission line for receiving the RF signal from the planar transmission line; at least one of metal patches formed inside the RF substrate and connected to the one side of the via for receiving the RF signal from the via; and a hole formed inside a low frequency substrate and connected to one side of the metal patch for receiving the RF signal from the metal patch.

In accordance with another aspect of the present invention, there is provided a transceiver module having a mode transition circuit including: a mode transition circuit for transferring a RF signal and having a planar transmission line mounted at a RF substrate, a via formed inside the RF substrate, at least one of metal patches, and a hole formed inside a low frequency substrate; an RF signal generating means mounted on the RF substrate; and a low frequency signal processing means mounted on the low frequency substrate, wherein the RF signal generated from the RF signal generating means is transferred to the low frequency signal processing means or to a RF signal processing means connected at the bottom of the low frequency substrate through the planar transmission line, the via, the metal patch and the hole.

ADVANTAGEOUS EFFECTS

In the present invention, a waveguide is formed for integrating a radio frequency (RF) substrate and a low frequency substrate. Therefore, the signal loss generated while transferring a RF signal can be minimized according to the present invention.

According to the present invention, a baseband processor or a power IC of a low frequency substrate can be effectively integrated with a RF substrate. Therefore, a transceiver module can be miniaturized, and the manufacturing cost thereof can be reduced.

According to the present invention, a mode transition circuit and a transceiver module using the same can be formed of inexpensive material and simple manufacturing processes.

BRIEF DESCRIPTION OF THE DRAWINGS

The above and other objects and features of the present invention will become apparent from the following description of the preferred embodiments given in conjunction with the accompanying drawings, in which:

FIG. 4 is a cross-sectional view of a transceiver module having a mode transition circuit for transferring a RF signal in accordance with another embodiment of the present invention.

BEST MODE FOR CARRYING OUT THE INVENTION

Other objects and aspects of the invention will become apparent from the following description of the embodiments with reference to the accompanying drawings, which is set forth hereinafter.

Figure 1:
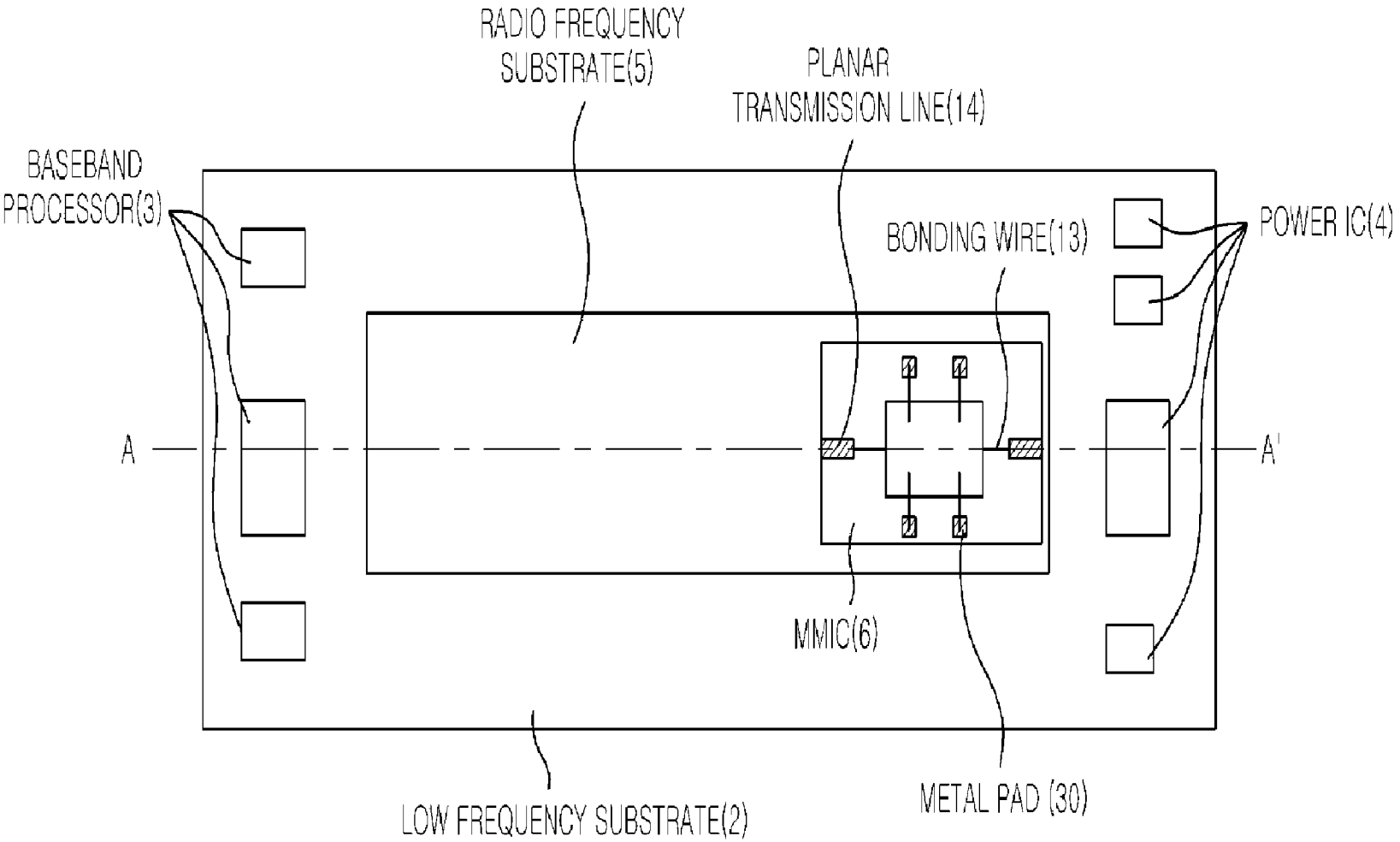
FIG. 1 is a top view illustrating a transition circuit for transferring a RF signal in accordance with an embodiment of the present invention.
Figure 2:
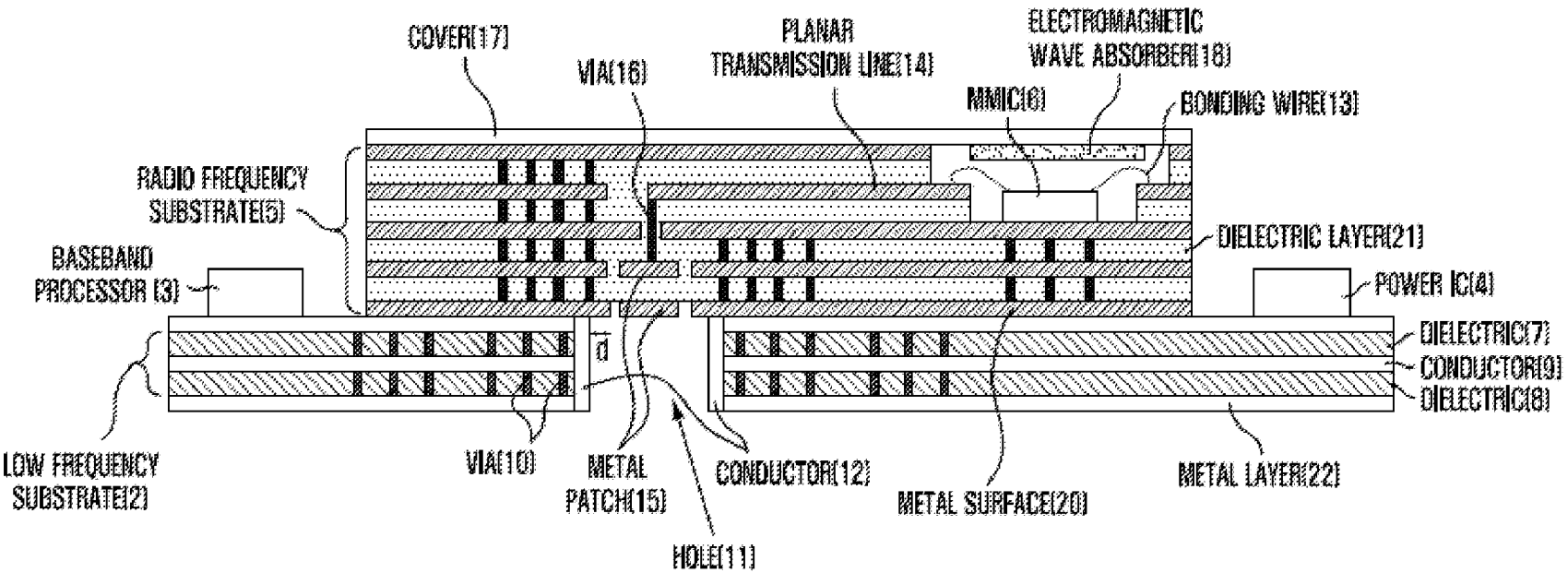
FIG. 2 is a cross-sectional view of FIG. 1 taken along the line A-A'.
Figure 3:
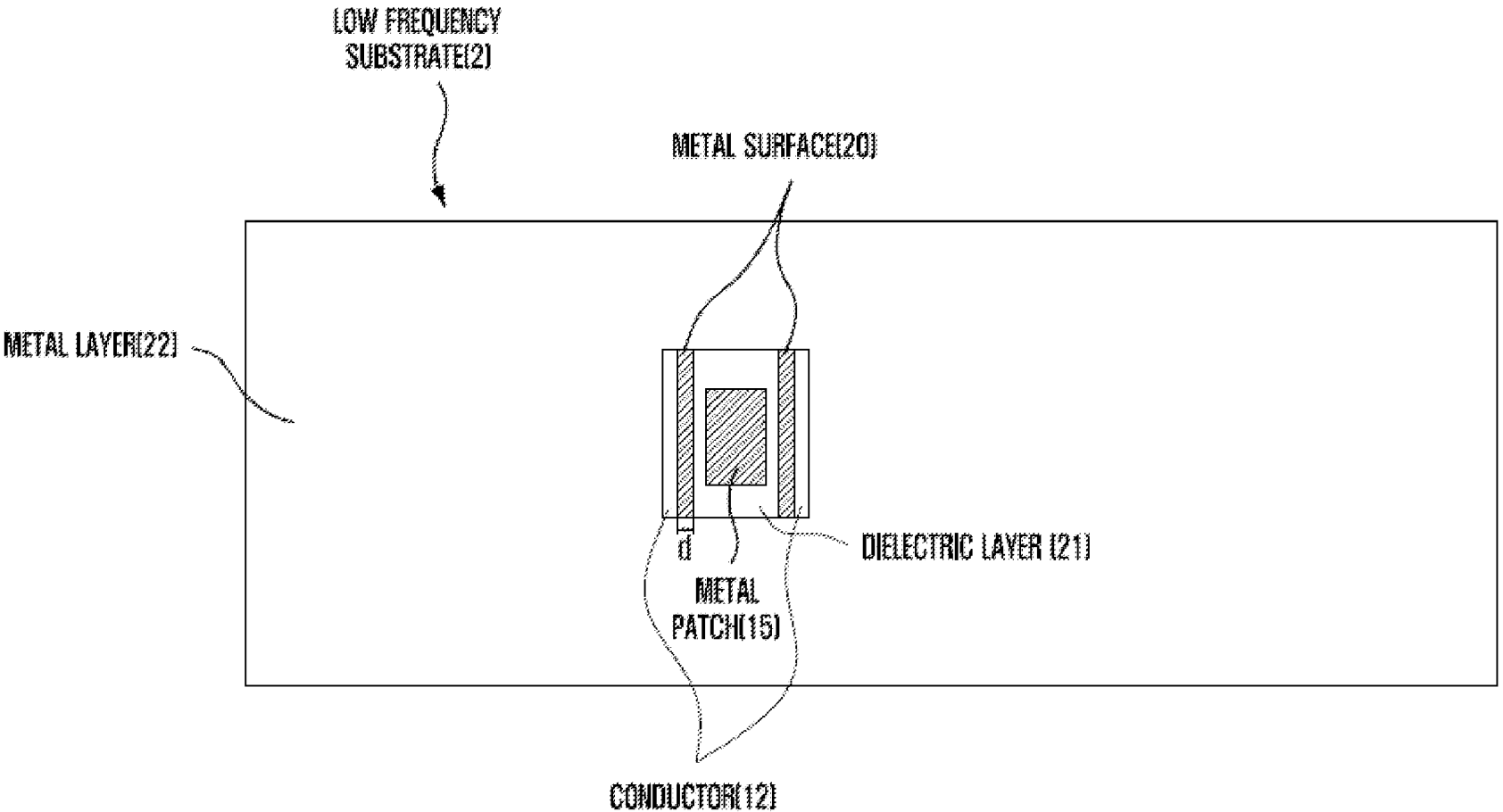
FIG. 3 is a bottom view of FIG. 1.

FIG. 1 is a top view illustrating a transition circuit for transferring a RF signal in accordance with an embodiment of the present invention, FIG. 2 is a cross-sectional view of FIG. 1 taken along the line A-A' shown in FIG. 1, and FIG. 3 is a bottom view of FIG. 1.

The present invention proposes a mode transition circuit for transferring a Radio Frequency (RF) signal generated from a RF substrate 5 (FIGS. 1, 2) to a module such as an antenna through a planar transmission line 14 (FIG. 2) and a waveguide including vias 16 (FIG. 2) and metal patches 15 (FIGS. 2, 3) formed inside the RF substrate 5 and a hole 11 (FIG. 2) formed inside a low frequency substrate 2, and a transceiver module having the same.

As described above, the present invention proposes the mode transition circuit for transferring a RF signal and a transceiver module having the same. Hereinafter, the mode transition circuit for transferring a RF signal and the transceiver module having the same will be described with reference to FIGS. 1 to 3.

FIGS. 1 to 3 show the transceiver module having the transition circuit for transferring a RF signal according to an exemplary embodiment of the present invention. The transceiver module according to the present embodiment includes a multi-layered low frequency substrate 2, a plurality of baseband processors mounted on the low frequency substrate 2, a plurality of power integrated chips (IC) 4 (FIGS. 1, 2), a multi-layered RF substrate 5, a monolithic microwave integrated chip (MMIC) 6 (FIGS. 1, 2) mounted on the RF substrate 5, and a mode transition circuit for transferring a RF signal. That is, the transceiver module includes a unit for transferring a RF signal from the planar transmission line 14 to the other module such as an antenna through a RF substrate 5 and low frequency substrate 2, which are formed in a shape of a waveguide. The transceiver module may include only one of the baseband processor 3 (FIGS. 1, 2) and the power IC 4, or include both of them on the low frequency substrate 2.

Furthermore, in the present invention, a RF signal generated from the RF substrate 5 is transferred to the other high frequency module through a waveguide and a low frequency substrate 2. That is, the present invention is characterized in transferring the RF signal through a low frequency substrate without any loss.

The mode transition circuit for transferring a RF signal according to the present embodiment includes a planar transmission line 14 for transferring a RF signal generated from a MMIC 6 of a RF substrate 5, a via 16 (FIG. 2) formed inside the RF substrate having one end connected to the planar transmission line 14, at least one metal patch 15 formed inside the RF substrate 5, and a hole 11 formed inside the low frequency substrate 2.

Generally, a wireless communication device must transfer a RF signal generated from a RF substrate 5 to other RF substrates or antennas so as to process the RF signal. In order to effectively transfer the RF signal, it is desirable to form a waveguide as a signal transferring path on a transceiver module. However, a low frequency substrate 2 generates a great signal loss while transferring the RF signal.

In order to overcome the shortcoming of the low frequency substrate 2, the hole 11 is formed inside the low frequency substrate 2, and the edge of the hole 11 is coated with a conductor, thereby forming the hole 11 to have a waveguide shape in the present embodiment. As described above, a signal transfer path for transferring a RF signal with a very small loss is embodied by forming the hole 11 having the conductor coated edge in the waveguide shape. Also, the baseband process 3 or the power IC 4 can be integrally formed with the high frequency substrate 5, thereby miniaturizing the transceiver module and reducing the manufacturing cost thereof.

The RF signal transferring path in the transceiver module according to the present embodiment will be described hereinafter.

A RF signal generated or amplified from the MMIC 6 of the RF substrate 5 is transferred to an antenna connected to the low frequency substrate 2 through a bonding wire 13 (FIGS. 1, 2), a planar transmission line 14, a via, a metal patch and a hole 11 formed inside the low frequency substrate 2. Also, the RF signal is transferred to the baseband processor 3 or the Power IC 4 mounted on the low frequency substrate 2.

The planar transmission line 14 may be formed as a microstrip transmission line, strip line or a coplanar waveguide (CPW). At least one dielectric layers 21 (FIG. 2) is formed inside the RF substrate 5.

The via 16 is formed inside the high frequency substrate 5. The via 16 is formed between the metal patch 15 of the RF substrate 5, which is connected to the hole 11 of the low frequency substrate 2, and the planar transmission line 14 of the RF substrate 5, which is connected to the MMIC 6 that generates the RF signal, thereby transferring the RF signal from the RF substrate 5 to the low frequency substrate 2.

The metal patches 15 can be formed on the RF substrate 5 as a stacked structure. Although the metal patch 15 is not stacked on the RF substrate 5, a RF signal can be transferred without any problems. If the metal patch 15 is formed on the RF substrate 5 as a stacked structure, a bandwidth for transferring the RF signal can be expanded.

As shown in FIG. 2, the low frequency substrate 2 includes a first dielectric 7 disposed at an upper portion thereof as a layer, a second dielectric 8 disposed at a lower portion thereof as a layer, and a conductor 9 interposed between the first and second dielectrics 7 and 8. A plurality of vias 10 are used to connect the conductor 9. The layers in the low frequency substrate 2 may be formed repeatedly.

As described above, a metal waveguide is formed of the hole 11 formed in the low frequency substrate 2 with the via 16 and the metal patches 15 formed inside the RF substrate 5. It is preferable to form a conductor 12 on the surface of the low frequency substrate 2, which forms the hole 11, through a plating process in order to enable the hole 11 to perform a metal waveguide function. That is, the signal is transferred through the via 16 and the metal patch 15 of the RF substrate 5 without signal loss by forming the conductor 12 on the surface of the low frequency substrate 2.

FIG. 3 shows a bottom view of a transceiver module in accordance with an embodiment of the present invention. As shown in FIG. 3, a metal layer 22 surrounds the bottom of the low frequency substrate 2, and a metal patch is formed at the bottom of the radio frequency substrate 5. A metal surface 20 for a RF substrate ground is formed one side of the metal patch 15 of the RF substrate 5.

The bottom of the transceiver module is connected to the other module. For example, the hole 11 of the low frequency substrate 2 is connected to a horn antenna, a planar antenna, or a second RF substrate 60 shown FIG. 4.

As shown in FIG. 2, the metal surface 20 is formed on one side of the metal patch 15 of the RF substrate, which is adjacent to the hole 11 formed at the low frequency substrate 2, for the RF substrate ground. It is preferable that the size of the hole 11 formed in the low frequency substrate 2 is separated from the edge of the metal surface 20 at a predetermined distance d in order to optimize for transferring a signal. Also, it is preferable to control the distance d in consideration of a frequency band and a power of a RF signal generated from the transceiver module.

While the transceiver module processes a signal, for example, transferring a RF signal, the large amount of heat is generated from a substrate. In order to evacuate heat generation, it is preferable that the metal layer 22 is formed on the bottom of the low frequency substrate 2 for heat sink.

A hole is formed at the metal layer 22 surrounding the bottom of the low frequency substrate 2 to have a same size of the hole 11 formed at the low frequency substrate 2 to effectively transfer a RF signal to an antenna.

Although the metal layer 22 is described to surround the entire bottom of the low frequency substrate 2 with metal, a predetermined portion of the bottom of the low frequency substrate 2 may be only surrounded with metal.

In the RF substrate 5, the MMIC 6 and the planar transmission line 14 are connected through a bonding wire 13. Such a boding wire 13 can be used to connect the MMIC 6 and the metal pad 30 (FIG. 1). The metal pad 30 directly transfers the RF signal generated from the MMIC 6 to a predetermined module. Herein, a plurality of MMICs 6 may be formed on the RF substrate 5.

The top of the RF substrate 5 can be covered by a cover 17 formed of metal or difference material. Also, it is preferable that an electromagnetic wave absorber 18 is formed on the MMIC 6 of the RF substrate 5 to prevent the electromagnetic wave from being reflected.

Furthermore, it is preferable to connect the RF substrate 5 on the low frequency 2 using adhesive such as soldering without performing a ball grid array (BGA) process or a u-BGA process.

In the present embodiment, it is preferable that the RF substrate 5 and the low frequency substrate 2 have different dielectric constant for effectively transiting a RF signal to a low frequency signal and transferring the low frequency signal. For example, the low frequency substrate is formed of a material having a great dielectric loss such as FR4, and the RF substrate 5 may be made of a material having a small dielectric loss such as LTCC, or alumina.

FIG. 4 is a cross-sectional view of a transceiver module having a mode transition circuit for transferring a RF signal in accordance with another embodiment of the present invention.

Referring to FIG. 4, the transceiver module according to the another embodiment of the present invention includes a low frequency substrate 2, a first RF substrate 50 mounted on the low frequency substrate 2, and a second RF substrate 60 mounted on the bottom of the low frequency substrate 2.

The present application contains subject matter related to Korean patent application No. 2005-119620, and No. 2006-72417, filed in the Korean Intellectual Property Office on Dec. 8, 2005, and Jul. 31, 2006, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A transition circuit for transferring a radio frequency (RF) signal comprising:

a low frequency substrate with a first dielectric constant;

a RF substrate, with a second dielectric constant different from the first dielectric constant, mounted on the low frequency substrate;

a planar transmission line mounted at the RF substrate for receiving a RF signal from a RF signal generating means;

a via disposed inside the RF substrate and connected to one side of the planar transmission line for receiving the RF signal from the planar transmission line;

at least one metal patch disposed inside the RF substrate and connected to the one side of the via for receiving the RF signal from the via; and a hole disposed inside the low frequency substrate and connected to one side of the at least one metal patch for receiving the RF signal from the at least one metal patch, wherein the low frequency substrate is a material having a large dielectric loss, and the RF substrate is a material having a small dielectric loss.

2. The transition circuit as recited in claim 1, wherein a conductor is coated on an edge of the hole disposed inside the low frequency substrate.

3. The transition circuit as recited in claim 1, wherein the transition circuit comprises the at least one metal patch forming a stacked structure in the RF substrate.

4. The transition circuit as recited in claim 1, wherein a at least one metal surface is disposed at one side of the metal patch of the RF substrate, which is adjacent to the hole formed inside the low frequency substrate.

5. The transition circuit as recited in claim 4, wherein the size of the hole disposed inside the low frequency substrate is separated from an edge of the metal surface disposed at one side of the at least one metal patch at a predetermined distance.

6. The transition circuit as recited in claim 1, wherein a metal layer is disposed on the bottom of the low frequency substrate, and a hole is disposed at the metal layer to have the same size of the hole disposed inside the low frequency substrate.

7. The transition circuit as recited in claim 1, wherein the planar transmission line and the RF signal generating means are connected through a bonding wire.

8. The transition circuit as recited in claim 1, wherein the planar transmission line comprises:

a dielectric layer, another dielectric layer, and a conductor interposed between the dielectric layers.

9. A transceiver module having a mode transition circuit comprising:

a low frequency substrate with a first dielectric constant;

a RF substrate, with a second dielectric constant different from the first dielectric constant, mounted on the low frequency substrate;

a mode transition circuit for transferring a RF signal and having a planar transmission line mounted at the RF substrate, a via disposed inside the RF substrate, at least one metal patch, and a hole disposed inside the low frequency substrate;

an RF signal generating means mounted on the RF substrate; and a low frequency signal processing means mounted on the low frequency substrate, wherein the RF signal generated from the RF signal generating means is transferred to the low frequency signal processing means or to a RF signal processing means connected at the bottom of the low frequency substrate through the planar transmission line, the via, the at least one metal patch and the hole, and wherein the low frequency substrate is a material having a large dielectric loss, and the RF substrate is a material having a small dielectric loss.

10. The transceiver module as recited in claim 9, wherein the low frequency substrate includes a first dielectric disposed at a top thereof as a layer, a second dielectric disposed at a bottom thereof as a layer, and conductors interposed between the first and second dielectrics, wherein a plurality of vias are disposed inside the low frequency substrate for connecting between the conductors.

11. The transceiver module as recited in claim 9, wherein the RF substrate includes: the at least one metal patch having a stacked structure inside the RF substrate, and a stacked structure of a first dielectric layer disposed inside the RF substrate with a planar transmission interposed and a second dielectric layer are disposed repeatedly.

12. The transceiver module as recited in claim 9, wherein a metal cover is mounted on the top of the RF substrate.

13. The transceiver module as recited in claim 9, wherein an electromagnetic wave absorber is disposed on the top of the RF signal generating means of the RF substrate.

14. The transceiver module as recited in claim 9, wherein the RF substrate and the low frequency substrate are connected by adhesive.

* * * * *